US005650909A

United States Patent [19]

Remele et al.

[11] Patent Number: 5,650,909

[45] Date of Patent: Jul. 22, 1997

[54] METHOD AND APPARATUS FOR DETERMINING THE ARMATURE IMPACT TIME WHEN A SOLENOID VALVE IS DE-ENERGIZED

[75] Inventors: Jörg Remele, Immenstaad; Andreas Schneider, Friedrichshafen, both of Germany

[73] Assignee: MTU Motoren- und Turbinen-Union, Germany

[21] Appl. No.: 529,491

[22] Filed: Sep. 18, 1995

[30] Foreign Application Priority Data

Sep. 17, 1994 [DE] Germany ..... 44 33 209.2

[51] Int. Cl.[6] ..... H01H 47/28

[52] U.S. Cl. ..... 361/154; 361/170

[58] Field of Search ..... 361/143, 153–154, 361/159–160, 170, 152; 251/129.15, 129.16

[56] References Cited

U.S. PATENT DOCUMENTS 4,930,040 5/1990 Binarsch et al. ..... 361/154

5,471,360 11/1995 Ishikawa et al. ..... 361/154

FOREIGN PATENT DOCUMENTS 37 30 523 4/1991 Germany .

42 37 706 5/1994 Germany .

2 041 659 9/1980 United Kingdom .

OTHER PUBLICATIONS

Patent Abstract of Japan for JP4196203 dated Jul. 16, 1992.

Foreign Search Report dated Jul. 5, 1996.

*Primary Examiner*—Jeffrey A. Gaffin

*Assistant Examiner*—Michael J. Sherry

*Attorney, Agent, or Firm*—Evenson, McKeown, Edwards & Lenahan P.L.L.C.

[57] ABSTRACT

This invention relates to a method and apparatus for recognizing the impact time of a solenoid valve armature during de-energizing. In order to obtain a detectable impact signal of the armature, a measuring current is provided in the magnet coil during the armature's downward movement to generate a magnetic measuring field. When this magnetic measuring field is changed due to the armature movement, an induction voltage is generated, which is monitored to detect the time of impact of the armature.

11 Claims, 2 Drawing Sheets

METHOD AND APPARATUS FOR DETERMINING THE ARMATURE IMPACT TIME WHEN A SOLENOID VALVE IS DE-ENERGIZED

BACKGROUND AND SUMMARY OF THE INVENTION

This invention relates to a method and apparatus for determining the impact time of a valve armature of a solenoid valve, such as is used, for example, in a fuel injector of a vehicle internal combustion engine.

In fuel injection technology, it is important to determine the opening and closing times of the injection valves as accurately as possible in order to maintain given limit curves from one injection to the next without any control, for example, to minimize exhaust emissions. If the respective opening and closing times of the injection valve are known, the fuel quantity injected during the open phase can be determined from the sequence of the internal movements of the injector.

The opening and closing times of the injection valve are, in turn, determined from the armature impact in energizing and de-energizing of the solenoid. In the operating sequence of the injectors, the two impact times are affected by the spring biasing of the valve armature; and fluctuations of the opening and closing behavior of the injection valves caused by spring tolerances, spring holding and mechanical mounting tolerances can be compensated by suitably regulating the injection technique.

Measuring methods for determining the energizing impact time are described, for example, in German Patent Documents DE 42 37 706 A1 and DE 37 30 523 A1 in connection with the start of the injection. Energizing measuring methods will therefore not be discussed in detail in the following.

Concerning the armature impact time after de-energizing of the solenoid (that is, at the actual end of injection), German Patent Document DE 37 30 523 A1 discloses an arrangement in which, after the actuating current is switched off by means of the magnet winding, the induction voltage caused by the movement of the solenoid armature in the magnet winding is amplified to a detectible signal level by means of an external energy source, in order to better monitor the switching times which are thus indicated more clearly.

Although the latter technique clearly indicates the switch-off time of the actuating current during energizing, it nevertheless has the disadvantage that a signal which is quite weak must be amplified. Particularly during de-energizing, such a signal is extremely indistinct and hard to determine, because the magnet coil must be completely de-energized in order to cause the magnet armature to drop. In practice, this is achieved by feeding a high extinguishing voltage. However, since the coil of the solenoid is not energized during the actual travel phase, the magnetic circuit is demagnetized. Thus, no magnetic field is built up in the magnet coil, and no magnetic interactions occur between the positional and motional relationship of the valve armature and the magnet coil. As a result, no induced voltage is available to detect the impact.

It is therefore an object of the present invention to provide a method and apparatus which achieves a clear determination of the armature impact time after the de-energizing, by technically simple means, at a reasonable cost.

This object is achieved by the method and apparatus according to the invention, in which current is built up separately in the magnet coil after an armature adhesion point is exceeded (that is, after the start of the armature travel phase). This measuring current must be large enough to create a magnetic field in the magnet coil which is sufficient to generate a recognizable induction voltage when changes occur. However, at the same time, this measuring current should also be low enough that the magnetic field which it generates will not hinder the armature's downward movement.

An important advantage of the technique according to the invention is that it eliminates the need for quantitative processing of a signal which is hard to interpret. Rather, the induction voltage signal itself, used to determine the impact time, is qualitatively much more clearly recognizable. In addition, such a reinforcement of the cause takes place completely independently of a possible subsequent processing of the induction voltage signal.

By virtue of the clearly determinable de-energizing armature impact time according to the invention, and with the determination of the energizing armature impact time known from the state of the art, adjustment of the armature spring biasing is unnecessary. Since therefore the injection valves no longer have to be calibrated, their handling requires lower costs during manufacturing and exchange.

Furthermore, in the case of injection valves, because of the clearly identifiable closing time signal obtained according to the invention, devices for amplifying the signal, which require high cost wiring, are unnecessary. For this reason, the injection valves and the solenoid contained therein may have a simpler and smaller construction.

According to the invention, the measuring current built up in the magnet coil during the travel phase of the valve armature is maintained at a constant value in order to obtain a voltage signal which is induced exclusively by the armature drop-out movement.

A clearly determinable induction voltage signal is therefore generated so that reading and/or recognition errors, which result from a weak or insufficiently pronounced signal, can be avoided. Furthermore, signal voltage values suitable for regulating purposes, may also be reached inductively as a result of the armature's downward movement in the magnet coil, without any additional signal processing or signal amplification. In addition to the fact that previously required signal amplification devices are thus no longer necessary, which simplifies the regulator expenditures, the method and apparatus according to the invention also provide a distortionless signal course, on which no additional time-related or qualitative interfering influences are imposed.

An interference-free motion signal of the magnet armature obtained in this manner, with a distinctive signal during the armature impact that remains clearly recognizable over many injections, permits a preferred embodiment of the invention in which the measuring current connected during the armature travel phase is held to a constant value. The purpose of keeping the current constant is to compensate for magnetic field changes in the magnet coil which result from fluctuations of the magnetic field exciting current (that is, of the measuring current).

It is a basic advantage of such measuring current regulation that mutual compensation of voltage induced in the magnet coil and the auxiliary voltage which drives the measuring current (and is essentially opposite), can be avoided. This ensures that an energetically constant magnetic field exists in the solenoid valve coil over the whole armature downward travel phase, and thus only those magnetic field changes which are caused by the position or the motion of the armature determine the signal course.

In order to control the measuring current to a desired constant value, according to another advantageous embodiment of the invention, depending on the respective requirements, both positive and negative auxiliary voltages are alternately added to the magnet voltage in order to ensure the controllability of the current, irrespective of the direction and amount of the induced voltage.

The invention can expediently be practiced using known current/voltage regulators. However, such regulators can only control a constant measuring current if a corresponding auxiliary voltage signal is present as the regulator input quantity. Particularly in an embodiment of the method according to the invention in which the measuring current is controlled to a constant value, therefore, it is necessary for problem-free regulator operation, that the maximum value of the positive or negative adjustable auxiliary voltage which can be fed to the magnet coil be larger than the voltage induced in the magnet coil during the travel phase. For this purpose, the auxiliary voltage may analogously be fed to the magnet coil, so that a particularly low-cost regulator device may be used.

It is also advantageous to switch a timed auxiliary voltage to the magnet coil in order to keep the power loss of the end stage as low as possible.

A suitable device for implementing the invention therefore provides a controllable auxiliary voltage source, in the form of an analog or digital computer, which is series-connected with the magnet coil. A particularly simple and low cost arrangement is obtained if the device provided for the rapid de-energizing of the magnet coil is also used to generate the controllable auxiliary voltage, which can be fed to the solenoid valve coil by means of components which exist in the device anyhow.

Other objects, advantages and novel features of the present invention will become apparent from the following detailed description of the invention when considered in conjunction with the accompanying drawings.

DETAILED DESCRIPTION OF THE DRAWINGS

Figure 1:
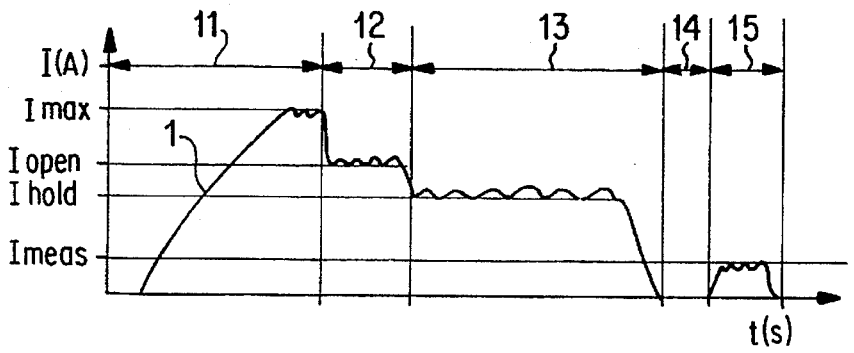
FIG. 1 is a qualitative graphic depiction of the generic control current waveform during an injection valve operation.

FIG. 1 illustrates the characteristic energizing waveform of a solenoid valve of the generic type, over an operating cycle of an injection valve, including energizing and de-energizing. This control current waveform may essentially be divided into five successive phases 11, 12, 13, 14, 15. In range 11, the current I is controlled to rise as rapidly as possible to the maximum current value $I_{max}$ in order to build up, as fast as possible, a magnetic field in the magnetic coil which is sufficient to actuate the solenoid valve (that is, to lift of the valve armature). The rise to the maximum value is required at this point in order to overcome the resistance that occurs according to Lenz's Law during the energizing, which tends to counteract the build-up of the magnetic field. When these initial resistances are overcome and the armature moves, the lower current $I_{open}$ controlled during the lifting phase 12 will be sufficient to move the armature into its open position. When the armature has reached its open position, the injection valve has opened up and fuel is injected.

Since, during the injection, the armature needs only be held in its open position, a lower holding current $I_{hold}$ (holding phase 13) is sufficient to overcome the static closing forces applied to the engine. Finally, with the drop of the holding current $I_{hold}$ to zero, the valve closing phase is initiated.

In practice, the closing phase (and therefore the armature drop-down movement) is frequently accelerated by switching an extinguishing voltage onto the solenoid valve coil, thereby compensating the existing magnetic field. If, in this case, after a defined time, the current drops off under a device-caused value, the magnetic holding forces will no longer be sufficient and the armature drop-down phase, that is, the downward travel phase, will start.

The energizing waveform described thus far is known from the state of the art. According to the invention, subsequent to the de-energizing phase 14, a measuring current $I_{meas}$ is actively built up in the magnet coil which current, in turn, generates a weak magnetic field in the coil by the process of induction.

When the measuring current is connected, it is essential that it be maintained at value which ensures that a magnetic field is built up in the magnet coil such that the resulting valve armature parameters furnish a clearly recognizable induction voltage signal. During the measuring phase 15, this measuring current is thus continuously controlled to maintain a set value in order to provide the necessary substantially constant magnetic field to detect changes caused by the armature drop-down movement. When the energy of the magnet coil is substantially constant, an induction voltage signal is obtained which is proportional to the armature rate of movement, so that the armature impact time can be read, and supplied as an output signal of an injection control device to the corresponding solenoid valve.

The amount of injected fuel is determined based on the detected timing of the armature's energizing impact, its de-energizing impact and the provided armature lift course. A method of measuring the armature impact during energizing at the start of feeding is described in the applicant's German Patent Document DE 42 37 706 A1. Therein, the coil of the solenoid valve is fed with a timed exciting current and the change of the pulse-width repetition rate of the exciting current, (that is, of the measuring current), which occurs during the impact of the armature, is used to determine the impact time. The pulse-width repetition rate (a pulse pattern of the relationship between the switch-on and switch-off times of the timed measuring current for the coil of the magnetic valve) changes in a clearly recognizable manner upon impact of the armature and can easily be evaluated.

By means of the method and apparatus according to the present invention, the de-energizing impact is now also recognized by means of measuring techniques, as a result of the processing of the armature impact signal by means of regulating techniques. Thus, the valve opening time can also be regulated by way of a corresponding control signal and, as a function thereof, also the amount of injected fuel.

Figure 2:
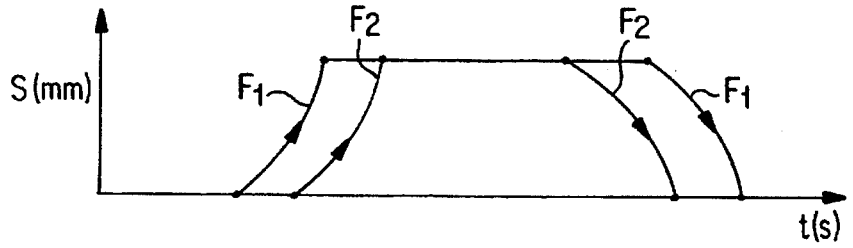
FIG. 2 is a graph which shows needle lift for two valve needles with different levels of spring bias.

As examples, two different needle lift courses $F_1$, $F_2$ are shown in FIG. 2 over the time. (The spring bias of the armature according to course $F_2$ is larger than that of course $F_1$.) A comparison of both courses $F_1$, $F_2$, shows that in the case of a higher spring bias, a later pick-up and an earlier drop-down of the armature will take place. Thus, the amount of injected fuel will be smaller than in the case of a lower spring bias $F_1$. Such different biases which may occur, for example, as a result of tolerances in manufacturing, have heretofore been balanced by corresponding adjustments or calibration of the spring bias. If there is no adjustment of the spring, or if the spring suffers from fatigue with the course of time or its spring constant changes with temperature, according to the invention, the injected amount of fuel can be determined from the time difference of the two impact times.

Figure 3:
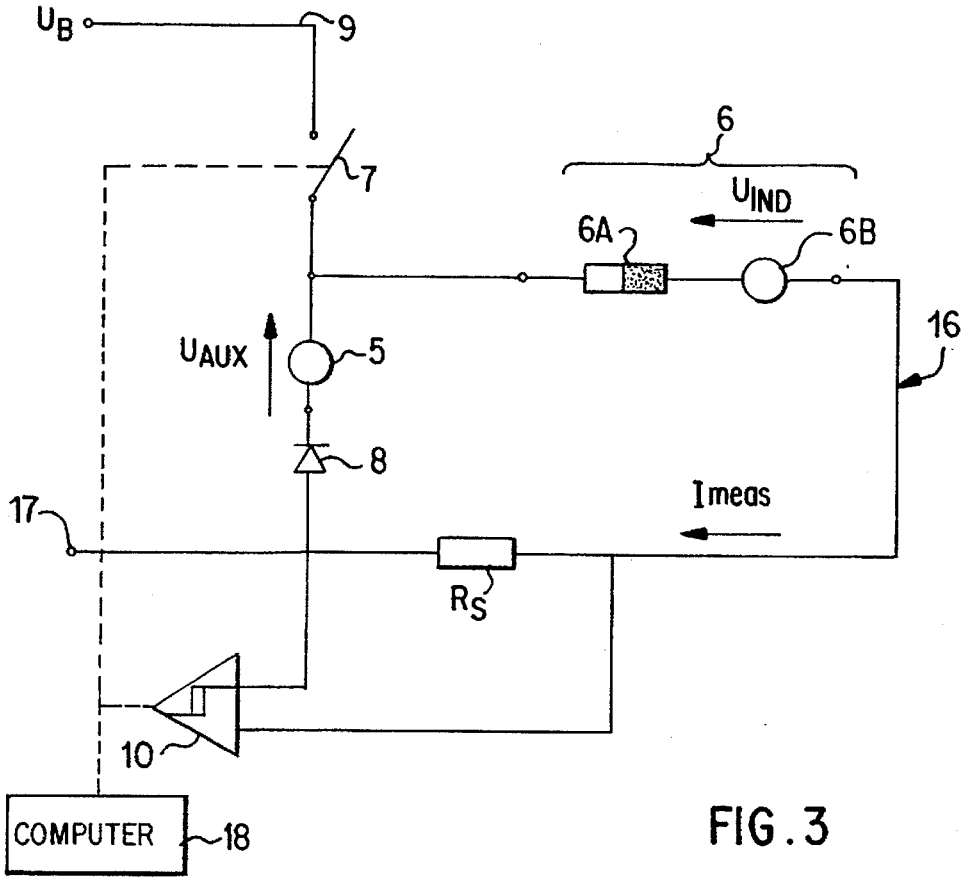
FIG. 3 is a simplified schematic representation of an embodiment of the wiring of a solenoid valve according to the invention.

FIG. 3 is a simplified circuit diagram which shows the elements utilized according to the invention to apply the measuring current $I_{meas}$ to the solenoid coil during the travel phase of the solenoid armature in order to generate a distinct signal indicative of valve closing, as described above. Details concerning the conventional current elements for applying and controlling the control current are omitted for the sake of simplicity.

In general, the measuring current $I_{meas}$, which is indicated by an arrow is provided from a fixed voltage source $U_B$, and its magnitude is controlled by the opening and closing of a switch 7 according a pulse width modulated signal generated by the comparator 10. $I_{meas}$ flows through the switch 7 to the solenoid coil 6 (represented by a coil 6A and an associated induced voltage source 6B, as explained below) and a sensing resistor $R_S$, to a terminal 17. The comparator 10 senses the voltage drop across the resistor $R_S$, and outputs a PWM signal which controls the switch 7. Optionally, the output of the comparator 10 may be connected to a digital computer 18 (indicated by a dash line in FIG. 3) which calculates the impact time of the armature by evaluation of a pulse pattern of the output from the comparator 10.

Figure 6:
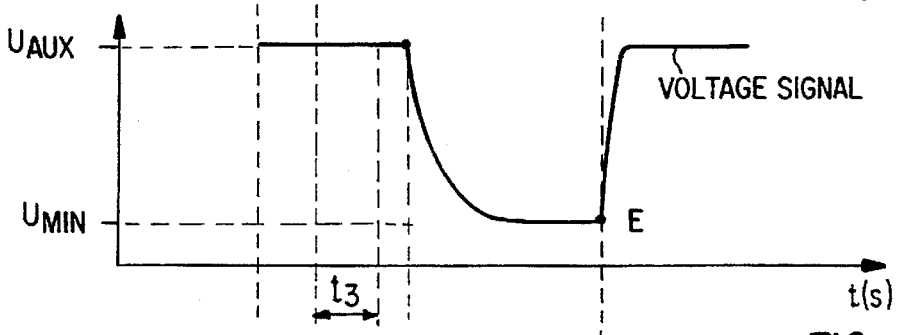
FIG. 6 shows a voltage signal obtained by the method according to the invention.

As explained hereinafter, the movement of the solenoid armature through the magnetic field generated in the solenoid coil 6A by the constant measuring current $I_{meas}$, causes an induced voltage $U_{ind}$ in the coil 6A, in a direction which opposes flow of $I_{meas}$. The circuit element 6B is included to represent the voltage $U_{ind}$, which is used to detect the precise point E at which the solenoid armature reaches its rest position. (See FIG. 6.) For reasons which are explained hereinafter, an auxiliary d.c. bias voltage $U_{aux}$ is superimposed on $U_{ind}$ (which has a polarity opposite that auxiliary voltage, as shown in FIG. 6). For this purpose, the auxiliary voltage source 5 ($U_{aux}$) is provided in the circuit of FIG. 3, with a diode 8, which prevents the diversion of $I_{meas}$ away from the solenoid 6.

FIGS. 4 to 8 illustrate graphically the method according to the invention for determining the de-energizing impact time by means of mutually dependent signal courses.

Figure 4:
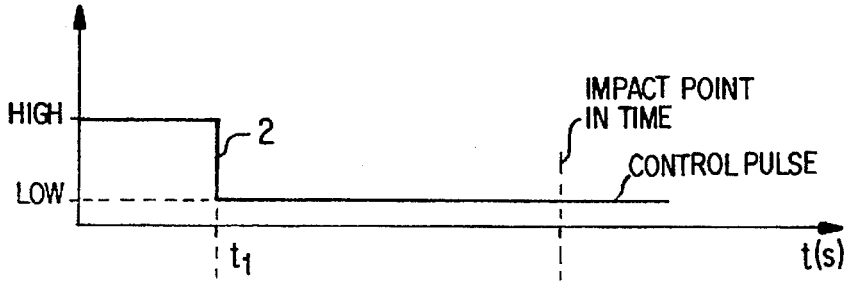
FIG. 4 is a qualitative graph depiction of the control current waveform.

The control signal in the form of a pulse 2 illustrated in FIG. 4 initiates the de-energizing of the solenoid valve coil at the point in time $t_1$. As a result of this control pulse 2, the control current 1 (FIG. 1) is reduced from the holding current $I_{hold}$ to "0". For this purpose, the control pulse causes connection of a quick-discharge device (not shown) to the solenoid valve which, by means of a high extinguishing voltage, compensates the potential drop at the magnet coil and causes the current abruptly to become "0".

However, even with the de-energizing by means of an extinguishing voltage, the magnet coil cannot be de-energized without any time delay, because here also Lenz's Law counteracts the forced magnetic field change. Corresponding to the resulting delay, the armature will overcome its adhesion at point H in the holding position only after a time period $t_2$.

Figure 5:
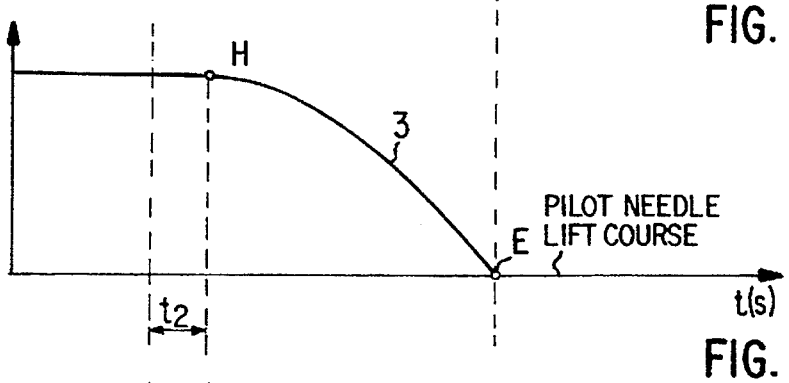
FIG. 5 is a graph which shows needle lift corresponding to the control current waveform in FIG. 4 during de-energizing.

The pilot needle course illustrated in FIG. 5 shows that the start of the armature travel phase with respect to the control signal, in a clearly time-staggered manner, will not start before point H. According to the invention, at or after the point in time H, a measuring current $I_{meas}$ is conducted through the coil 6 (FIG. 3). (The start of the measuring current build-up $I_{meas}$ is intentionally placed after the start of the travel phase of the armature (point H) in order to avoid a possible delay in the time H at which the adhesion point is exceeded, due to the magnetic field formed by the measuring current in the measuring coil.)

Figure 7:
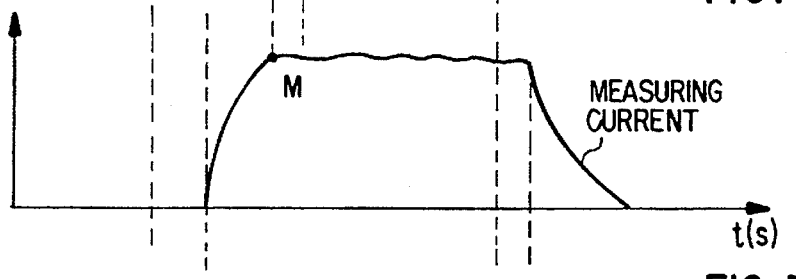
FIG. 7 shows the measuring current waveform according to the invention.
Figure 8:
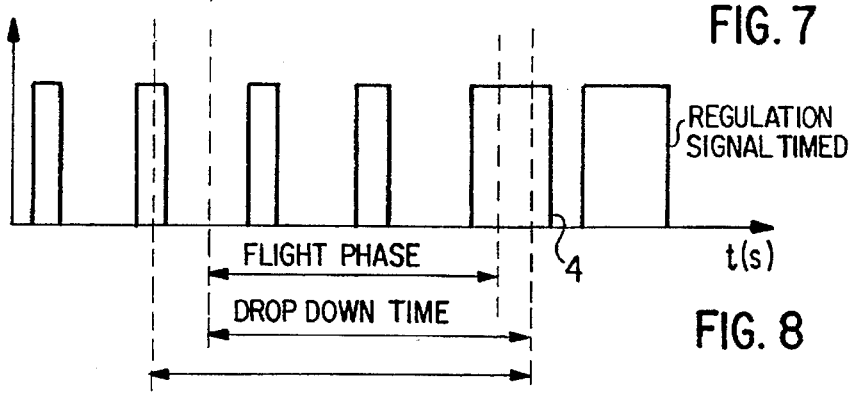
FIG. 8 shows the pulse pattern of a timed signal of a two-position current regulator.

When the adhesion point H has been exceeded, the armature moves 3 toward its closed position E (FIG. 5) while, in the interim, after the time delay $t_3$, the full measuring current $I_{meas}$ builds up in the magnet and reaches its final value at point M (FIG. 7).

During the time period $t_3$ between the adhesion point H and the point at which the full measuring current $I_{meas}$ is built up in the coil, the curves of the pilot armature travel and of the measuring current rise advantageously reinforce one another such that, during this time period, the armature is accelerated in its downward movement before the measuring-current-caused magnetic field is formed in its final intensity.

Starting from the point M to at least the impact time, the measuring current $I_{meas}$ is controlled by the circuit of FIG. 3, at a constant value in order to provide a uniform magnetic field in the magnet coil.

Because of the magnetic field generated by the measuring current, the downward movement of the armature causes a magnetic field change in the magnetic circuit which in turn induces a voltage $Un_{ind}$ in the solenoid valve coil. By sensing this voltage signal $U_{ind}$, the armature impact time can be detected due to a signal bend caused by the abrupt halt of the armature's movement, which is clearly indicated in the course of the voltage at point E in FIG. 6.

As noted previously, an auxiliary d.c. biasing voltage $U_{aux}$ is superimposed on the actual induction voltage signal for control-technical reasons. The amount of this auxiliary voltage is selected such that it is always larger than the voltage $U_{ind}$ induced in the solenoid valve coil. As a result, the voltage signal $U_{ind}$ illustrated in FIG. 6 appears as a negative (downward) pulse which partially offsets the positive auxiliary voltage.

During the travel phase, the induced negative voltage $U_{ind}$ will increase as the magnetic field change increases until the armature finally impacts, and no further changes of the magnetic field take place (point E). Without any magnetic field changes, no induction will take place so that the voltage signal will have a pronounced bend in point E as noted above.

Since the armature has now taken up its closed position and therefore no further induction is taking place, the measuring current (which is no long necessary) is also reduced again. The determination of the armature drop-down time is terminated.

The magnitude of the current $I_{meas}$, which builds up in the solenoid coil following the point H (at which the armature commences its travel phase) is controlled by the continuous uniform opening and closing of the switch 7, which is triggered by the output signal of the comparator 10 in FIG. 3. The pulse pattern generated by the comparator 10 in turn is determined by measuring the voltage drop across the sensing resistor $R_S$, which is proportional to the measuring current. This feedback arrangement thus facilitates the control of $I_{meas}$ to a constant set value as described previously. Also in this manner, the measured analog values of the measuring current $I_{meas}$ are converted to a series of digital (PWM) pulses.

It should be noted that when the valve armature is moving, the magnetic field of the magnet coil changes and a voltage is induced which opposes the flow of measuring current, so that when the measuring current is controlled to be constant, the voltage signal will decrease continuously. Due to the difference in the relative magnitude of these quantities, however, the pulse-width repetition rate will change only insignificantly. At the point in time of the impact (E in FIG. 6), at which the voltage signal experiences the pronounced bend, this is exhibited by a clear change of the pulse-width repetition rate.

In order to determine this change of the pulse-width repetition rate with respect to measuring techniques, the output signal of the comparator is simultaneously fed to the control unit 10, which carries out a time-critical pulse pattern evaluation whose result is used for calculating the point of time of the impact by using a programmable algorithm.

Alternatively, in place of a two-position current regulator, control of the measuring current $I_{meas}$ can also be carried out by means of an analog regulator without changing the essence of the invention.

Because the voltage induced in the magnet coil by the downward movement of the armature has a polarity which is opposite to that of the energizing current, when a two-position current regulator is used, the initial values of the recognition filter must be reversed to that of the energizing impact. In this manner, the point in time of the impact of the armature can be recognized by the change of the pulse-width repetition rate of the measuring current $I_{meas}$ occurring during the impact of the armature. This is represented qualitatively in FIG. 8 by means of the pulse-wide modulated (PMW) pattern of the current regulator. When the armature impact occurs, the pulse width 4 increases in a clearly visible manner.

During the downward travel of the solenoid armature, the induced voltage has a polarity opposite that which is generated during the upward movement (due to the opposite direction of travel). Thus, in the range of the impact, the two-position current regulator would not have a sufficient adjusting reserve. Even a solenoid valve coil which is permanently switched into the free-running circuit would cause the current to rise before the de-energizing impact above the upper regulator threshold, so that the regulator would opt out and a recognition of the impact time would become impossible. For this reason, the auxiliary voltage source 5 is connected in series with the solenoid valve, which auxiliary voltage source 5 permits the regulator to feed a voltage to the solenoid valve coil, which is poled oppositely to the vehicle voltage.

In the embodiment illustrated in FIG. 3, it should be noted that the auxiliary voltage is not provided as a separate new auxiliary voltage source. Rather, the device for the rapid de-energizing of the solenoid valve coil supplies and controls the required auxiliary voltage, by respective circuit-related adaptations.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. Method for determining the impact time of a valve armature of a magnetically actuated solenoid valve having a magnet coil for controlling movement of said armature by means of an interruptible control current which flows in said coil, said method comprising the steps of:

interrupting the control current to initiate a travel phase of said armature;

causing a measuring current to flow in the magnet coil during the travel phase of the armature, said measuring current having a magnitude sufficient to generate a magnetic field in the magnet coil which causes an induced voltage signal therein in response to movement of the armature, but does not hinder movement of the armature during the travel phase;

monitoring said induced voltage signal; and detecting impact of said armature based on a change in said induced voltage signal which occurs in response to said impact.

2. Method according to claim 1 wherein the measuring current is controlled to a constant value in the magnet coil during the travel phase of the valve armature.

3. Method according to claim 2 wherein for controlling the measuring current to a constant value, a negative auxiliary voltage is fed to the magnet coil.

4. Method according to claim 3 wherein a maximally adjustable negative auxiliary voltage which can be applied to the magnet coil is larger than that of the induced voltage in the magnet coil.

5. Method according to claim 1 wherein for controlling the measuring current, the auxiliary voltage is generated by timed pulses.

6. Method according to claim 1 wherein:

the magnet coil is fed by a timed measuring current; and a signal change which occurs in response to the impact of the armature is converted into a change of a pulse-width repetition rate of the measuring current, which is used to determine the point in time of the impact.

7. Device for determining the impact time of a valve armature of a magnetically actuated solenoid valve, comprising:

a control current circuit for actuating the solenoid valve by means of a selectively interruptible control current;

a switch for interrupting said control current to thus initiate a travel phase of the armature;

a control unit which actuates the switch corresponding to the desired injection times;

a closed clearing circuit with at least one free-running diode; and means for determining the armature impact time by means of a voltage fed to the magnet coil;

wherein the clearing circuit comprises an auxiliary voltage source for providing an auxiliary voltage which, when the switch is open, builds up a measuring current in the solenoid valve.

8. Device according to claim 7 wherein the means for determining the armature impact time comprises at least one comparator and a digital computer, the output of the comparator being connected with the digital computer which calculates the impact time by evaluation of a pulse pattern of said output of the comparator.

9. Device according to claim 7 wherein the auxiliary voltage source comprises a regulator having a voltage direction which can be reversed.

10. Device according to claim 9 wherein the regulator is one of: a two-point current regulator and an analog regulator.

11. Device according to claim 7 further comprising means for rapid de-energizing of the magnet coil by means of an extinguishing voltage which can be switched on, wherein the auxiliary voltage is supplied by the means for rapid de-energizing.

* * * * *